US006176350B1

(12) United States Patent
Schlosser

(10) Patent No.: US 6,176,350 B1
(45) Date of Patent: Jan. 23, 2001

(54) PROGRESSIVE SAFETY GEAR

(75) Inventor: Gerhard Schlosser, Dachau (DE)

(73) Assignee: Autzugstechnologie Schlosser GmbH, Dachau (DE)

( * ) Notice: Under 35 U.S.C. 154(b), the term of this patent shall be extended for 0 days.

(21) Appl. No.: 09/138,116

(22) Filed: Aug. 21, 1998

(30) Foreign Application Priority Data

Aug. 21, 1997 (EP) ..... 97810588

(51) Int. Cl.[7] ..... B66B 5/20

(52) U.S. Cl. ..... 187/368; 187/359; 187/370; 187/375; 188/41

(58) Field of Search ..... 187/359, 367–370, 187/374, 375; 188/41, 72.7

(56) References Cited

U.S. PATENT DOCUMENTS 5,487,450 * 1/1996 Gerber ..... 187/367

FOREIGN PATENT DOCUMENTS 805 782 3/1951 (DE) .
1081635 * 5/1960 (DE) ..... 187/369
21 39 056 2/1973 (DE) .
2943660 B1 * 1/1981 (DE) .
196 06 861 8/1997 (DE) .
899231 A1 * 3/1999 (EP) .
1368974 * 10/1974 (GB) ..... 187/369
2478051 * 9/1981 (GB) .
4-365772 * 12/1992 (JP) ..... 187/359

OTHER PUBLICATIONS

Article by Kabisch, et al. entitled Die Fangbremse BF ×3 aus dem ostdeutschen Aufzugsbau Dated Sep./Oct. 1991, pp. 63–41 published in LIFT–REPORT.

* cited by examiner

*Primary Examiner*—Robert P. Olszewski
*Assistant Examiner*—Thuy V. Tran
(74) *Attorney, Agent, or Firm*—Cohen, Pontani, Lieberman & Pavane

(57) ABSTRACT

A progressive safety gear for elevators, having a console which encompasses one guide rail for an elevator car and is positioned in a transverse direction to the guide rail. Two brake shoes are mounted on the console so as to be positioned one on each side of the guide rail. One of the brake shoes functions as a passive brake shoe and other as an active brake shoe. The active brake shoe is supported on an eccentric which is fastened to a cam so that they rotate together. The cam and the eccentric are able to rotate about a common pivot. The cam and the eccentric together form a single-part actuating element. Moving the elevator car in the direction opposite to the direction of engagement causes the cam to rotate backwards, which in combination with the vertical play on the passive brake shoe enables the engaged safety gear to be easily and safely released again. An alternative version is provided which has a multi-part actuating element with an adjustable angle.

8 Claims, 4 Drawing Sheets

PROGRESSIVE SAFETY GEAR

BACKGROUND OF THE INVENTION

1. Field of the Invention

The present invention relates to a progressive safety gear for elevators consisting of a carrier, which is positioned in a transverse direction to the guide rail and which encompasses one guide rail for an elevator car, on which two brake shoes which are positioned one on each side of the guide rail are supported. One of the brake shoes functions as a passive brake shoe and the other as an active brake shoe. The active brake shoe is supported on an eccentric which is fastened to a cam in such a way that it rotates with it. The cam and the eccentric are able to rotate about a common center.

2. Discussion of the Prior Art

A progressive safety gear of the type mentioned above is already known from German reference DE 21 39 056. In this safety gear the blocked governor rope actuates a tripping lever on the safety gear which causes the tensioning eccentric fastened to the positioning eccentric to rotate. As a result, the tensioning eccentric comes into contact with the guide rail. As a result of this, and because the elevator car is still moving, the tensioning eccentric continues to rotate of its own accord due to the friction contact with the guide rail, and the active brake shoe is moved into the braking position via the positioning eccentric. In the braking position, the positioning eccentric has reached the end position before the greatest distance from the guide rail, because in this position the tensioning eccentric, due to the shape of its external contour, has reduced or lost its friction contact with the guide rail and is therefore no longer caused to rotate.

However, this progressive safety gear functions only in one direction, either up or down, and it is not possible in all necessary cases to release it by moving the car in the direction opposite to the direction in which it fell. This means that the safety gear cannot always be simply released after it has engaged.

A progressive safety gear which also works with an eccentric is the safety gear BFx3 of the East German elevator industry (Liftreport, Issue 5, 1991). When this progressive safety gear is tripped, two cams with rolling and sliding surfaces are rotated either counter-clockwise or clockwise depending on the direction of travel of the elevator, which causes in the downward travel direction a strong, and in the upward direction a weaker, braking deceleration of the elevator car. Tripping takes place by means of a governor rope passing over a separate pulley which, by transmitting its rotational movement, causes the eccentric to rotate in one direction or the other depending on the direction of travel. If braking takes place in the upward direction the angle of rolling and the radius to the sliding surface in the braking position is smaller than when braking takes place in the downward direction. This results in a different degree of compression of the braking springs and correspondingly the desired different braking forces for the two directions of travel.

A disadvantage of this device is that the controlling surfaces and the braking surface are on the same component, because of which the braking surface has a relatively small contact surface, which after several trippings as a result of wear can lead under certain circumstances to a reduced braking effect or even to faulty functioning. The complete eccentric must then be replaced. Furthermore, because of the additional rotational transmission device, an elaborate and relatively expensive triggering device is necessary.

SUMMARY OF THE INVENTION

The object of the present invention is therefore to provide a safety gear which can produce in the two directions of travel the different braking effect required, and which does not have the disadvantages described above.

Pursuant to this object, and others which will become apparent hereafter, one aspect of the present invention resides in a progressive safety gear having a console arranged so as to encompass the guide rail and be in a transverse direction to the guide rail, an active brake shoe and a passive brake shoe supported on the console so as to be positioned on one each side of the guide rail, a cam rotatably mounted on the housing, and an eccentric fastened to the cam so that they rotate together between a ready position and braking positions. The cam and the eccentric are rotatable about a common center. The cam is rotatable in both a clockwise and a counter clockwise direction so that the safety gear can be tripped in both travelling directions. The cam is configured so as to remain in contact with the guide rail after a braking operation has taken place so as to permit the cam to be turned backwards, thereby making it possible to release the engaged safety gear by pulling the elevator car out of a position in which it is blocked.

The progressive safety gear according to the invention is simply constructed, inexpensive to manufacture, and easily to install. One aspect of the invention, among other things, is that the friction contact between the cam and the guide rail which is still present after the safety gear engages makes it easy to release the safety gear.

The passive brake shoe is able to move freely for a certain distance in a vertical direction during braking and when pulling the safety gear out of its engaged position. By initially reducing the frictional force, this makes it easier to pull the safety gear out of its engaged position.

The angles alpha and beta between the zero point of the point nearest to the guide rail of a cam in the ready position and the upper dead point of the eccentric, or the smaller working angle which is dependent on these two angles up to the point of braking, determine, in combination with the shape of the rolling contour of the cam, the ratio between the braking force in the downward direction and in the upward direction.

By means of the shape of the rolling contour of the cam, and particularly a flat point which in the ready position is turned towards the guide rail, individual characteristics for the start of deceleration, which means rapid initiation of the braking effect after the safety gear is triggered, can be achieved.

For certain applications the cam can also have an external contour in the shape of a circle, with or without a flat point, which makes it simpler and cheaper to manufacture.

The circular contour of the cam rolling on the guide rail results in an identical pattern of movement of the cam for both directions of travel, which means that only the rolling angle up to the point of braking (working angle), and to a partial extent the angular position between the cam and the eccentric, determine the ratio between the braking force in the two directions of travel.

The cam and the eccentric can be produced as a single piece, which is advantageous for manufacturing.

The cam and the eccentric can also be produced as separate parts whose angle in relation to each other can be adjusted, which makes it possible to influence certain parameters such as, for example, the onset of the braking effect.

The final position of the safety gear and of the cam when braking takes place is determined without a stopper by a naturally occurring equilibrium between the pressure forces of the active brake shoe and the cam.

The frictional engagement present between the guide rail and the cam, together with the vertical play of the passive brake shoe, makes it particularly easy to pull the safety gear out of its engaged position by rotating the cam in the reverse direction on the guide rail.

The various features of novelty which characterize the invention are pointed out with particularity in the claims annexed to and forming a part of the disclosure. For a better understanding of the ingestion, its operation advantages, and specific objects attained by its use, reference should be had to the drawing sand descriptive matter in which there are illustrated and described preferred embodiments of the invention.

DETAILED DESCRIPTION OF THE PREFERRED EMBODIMENTS

Figure 1:
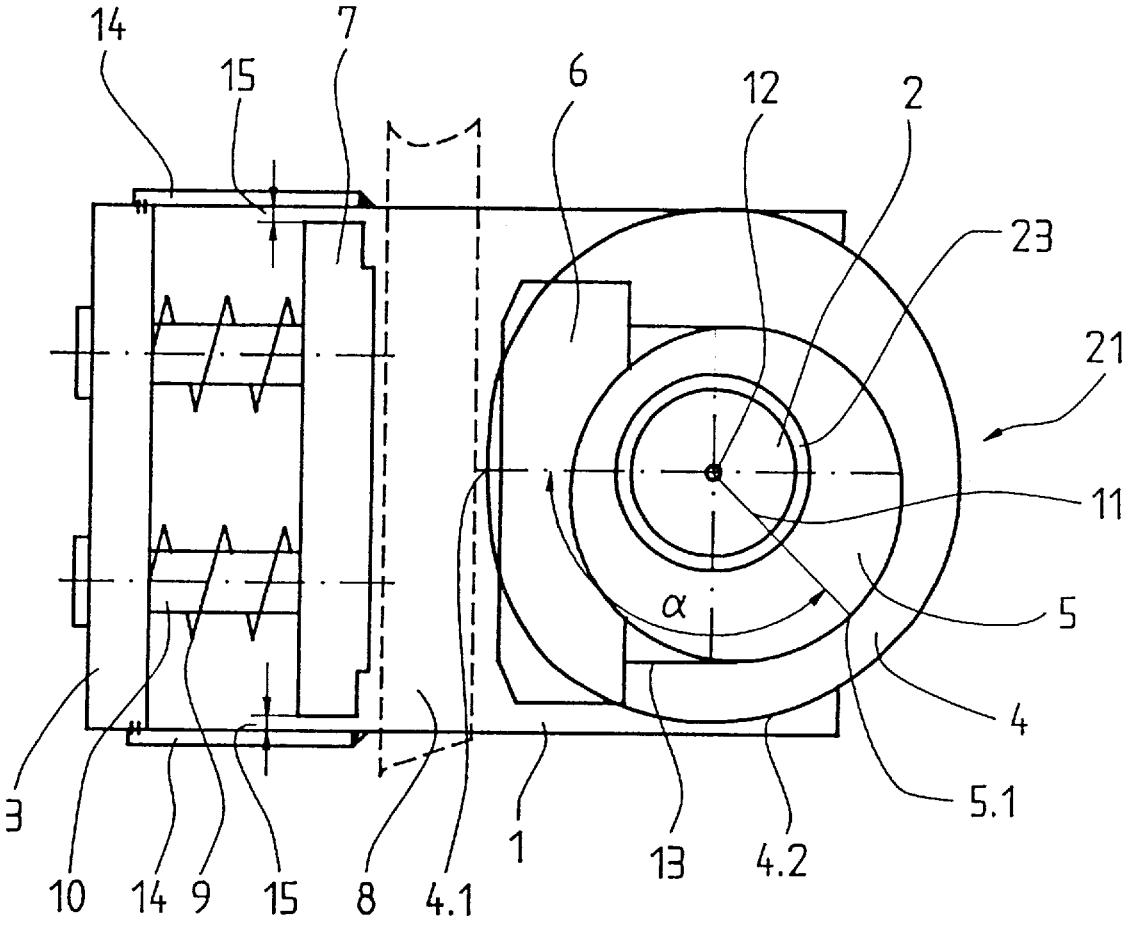
FIG. 1 is a view of the complete progressive safety gear pursuant to the present invention in the ready position.

FIG. 1 shows a console 1 to which at the left-hand extremity a thrust plate 3 and on the right-hand side a bearing journal 2 are non-detachably fastened. An actuating element 21 is fastened to the bearing journal 2 by means of a plain bearing bush 23 so that the actuating element 21 can rotate. The actuating element 21 consists of a larger cam 4 and a smaller eccentric 5 which is fastened to the cam 4 in such a way that it rotates with it. The eccentric 5 itself consists of two eccentric disks, which are positioned on the two sides of the cam 4 in the same position relative to each other. In the embodiment shown, the cam 4 has a flat point whose mid-point is designated as 4.1, and which in the ready position is parallel to the sliding surface of a guide rail 8, and a rolling contour 4.2 whose shape controls the braking force. Here the flat point 4.1 is an important part of the shape of the rolling contour 4.2 because by means of it an accelerated onset of the braking effect after the safety gear is tripped is achieved. In the case of a cam 4 without a flat point, the zero point 4.1 is the point on the circumference of the cam 4 nearest to the guide rail 8 when the progressive safety gear is in the ready position. On the eccentric 5 the maximum distance from the center 12 of the bearing journal 2 is designated as the upper dead point 5.1. The zero point 4.1 of the cam 4, and the upper dead point 5.1 of the working cam, are at an angle alpha to each other.

An active brake shoe 6 is attached by the bracket 13 to the eccentric 5 so that it can pivot, a recess in the shape of an arc of a circle on the right-hand side of the active brake shoe 6 being able to slide on the circular external surface of the eccentric 5. The active brake shoe 6 has in it a longitudinal slot to permit the cam 4 to pass through the middle of the active brake shoe 6.

On the left-hand side of the guide rail 8, and at a distance from it, a passive brake shoe 7 is positioned. Limit stops 14, one above and one below, serve as stops in the vertical direction. Vertical play 15 between the end face of the passive brake shoe 7 and the inner striking surface of the limit stop 14 is an important measure and serves in addition to make it easier to release the safety gear after braking has taken place. The passive brake shoe 7 is connected to two guide bolts 10 which pass through the thrust plate 3. Pressure springs 9 and a not illustrated adjusting device on the guide bolts 10 for pre-tensioning the springs hold the passive brake shoe 7 in the ready position and produce the braking force when the progressive safety gear is tripped.

Figure 2:
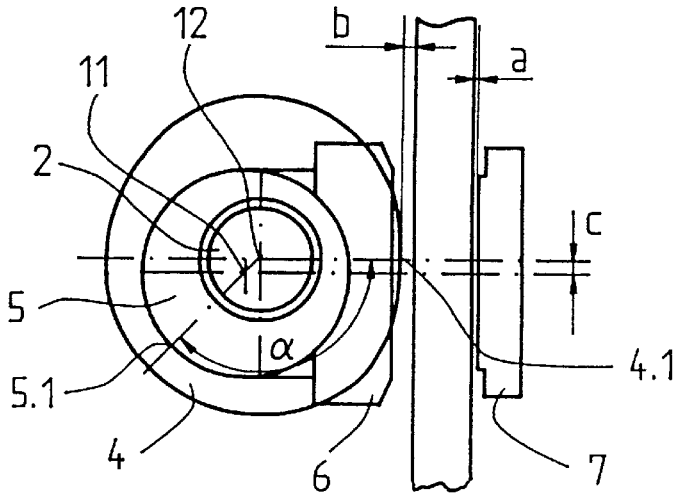
FIGS. 2 to 4 show a sequence of functioning as the progressive safety gear engages when travelling in the downward direction.

In FIG. 2 the progressive safety gear is shown in the ready position. The active brake shoe 6, the passive brake shoe 7 and the cam 4 are not in contact with the guide rail 8. The dimensions a and b are the distances from the passive brake shoe 7, and from the flat surface with the zero point 4.1 of the cam 4, to the guide rail 8. The dimension c is the momentary distance between the geometric center 11 of the eccentric and the center 12 of the bearing journal 2.

Figure 3:
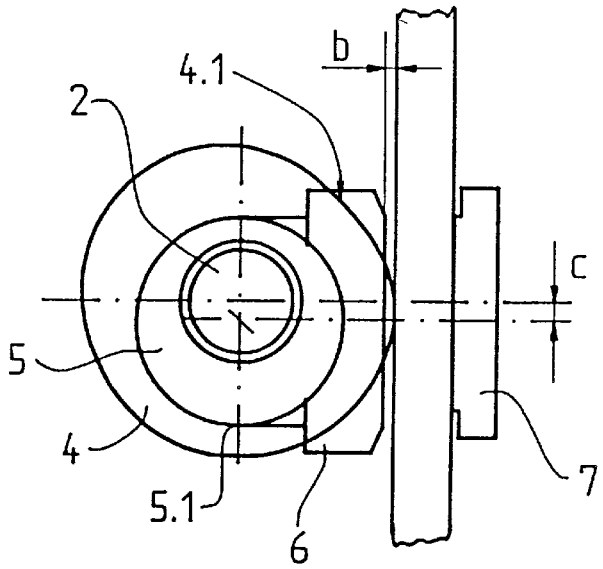

In FIG. 3 the progressive safety gear is shown in the engaged position. A tripping device, which is not shown, has turned the actuating element 21 some way counterclockwise, as a result of which the cam 4 becomes frictionally engaged by its knurled surface 4.2 with the guide rail 8 and is caused to roll further along the guide rail 8 by the continuing movement of the elevator. Following this, the entire progressive safety gear is pulled to the left and the passive brake shoe 7, whose pass by clearance is closed, comes into contact with the guide rail 8. The active brake shoe 6 is still at a distance b from the guide rail 8 and does not yet contribute to the braking action.

Figure 4:
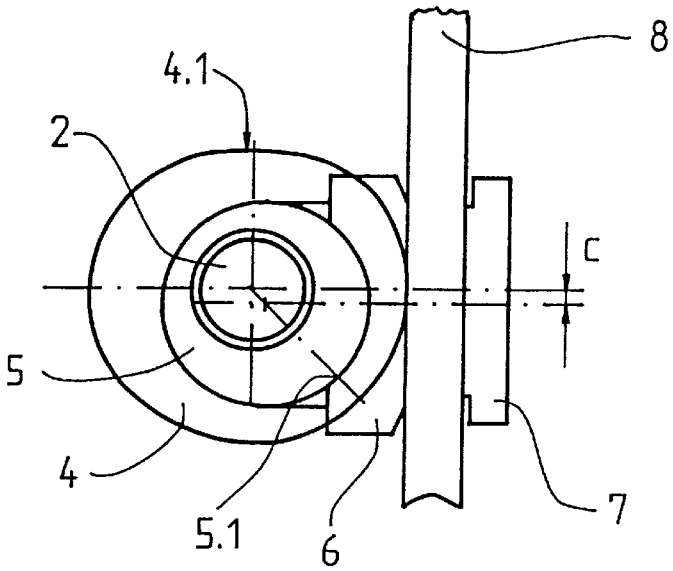

FIG. 4 shows the concluding phase of the safety gear engagement. Further rolling of the cam 4 of the guide rails 8 pulls the safety gear further to the left, this horizontal sliding movement and the rotation of the cam 4 cause the pressure springs 9 to be compressed, and this at the same time increases the pressing force of the passive brake shoe 7 and the cam 4. As the cam 4 continues to rotate, the eccentric 5 attached to it rotates with it, which then moves the active brake shoe 6 towards the guide rail 8 and causes friction contact to occur. A state of equilibrium arises between the cam 4 and the eccentric 5 against the active brake shoe 6. At this moment a stable distribution of the pressing forces of the cam 4 and the active brake shoe 6 is present, the sum of which corresponds to the pressing force of the passive brake shoe 7. At this point the normal force of the safety gear has reached the defined final value for braking in the downward direction. This defined value is determined by the pre-tensioning and characteristics of the pressure springs 9, the shape of the rolling contour 4.2 of the cam 4, and the angle alpha between the zero point 4.1 on the cam 4 and the upper dead point 5.1 of the eccentric 5, or the working angle that depends on this angle. The actuating element 21, or specifically the upper dead point 5.1 of the eccentric 5, comes to rest at an angle of approximately 30° before the point of contact with the guide rail 8. This means that the difference between the angle alpha or beta, and the angle which in this example is 30°, gives the working angle mentioned earlier of the cam 4 prior to the braking position of the progressive safety gear.

The elevator car, which is now blocked in its movement by the safety gear, can be released from the blocked position easily by pulling the car upwards, because the cam 4 has friction contact with the guide rail 8 for turning it backwards and because the upper end-face of the passive brake shoe 7 is in contact with the upper limit stop 14. The lower end-face of the passive brake shoe 7 has double the amount of vertical clearance 15 so that when the elevator car is pulled upwards the passive brake shoe 7 does not brake during this distance, which makes it easier to pull the elevator out of the blocked position by rolling the cam 4 on the guide rail 8 in the direction of release.

The sequence of events that occurs when braking by the safety gear takes place in the upward direction of travel is described below by reference to FIGS. 5 to 7.

Figure 5:
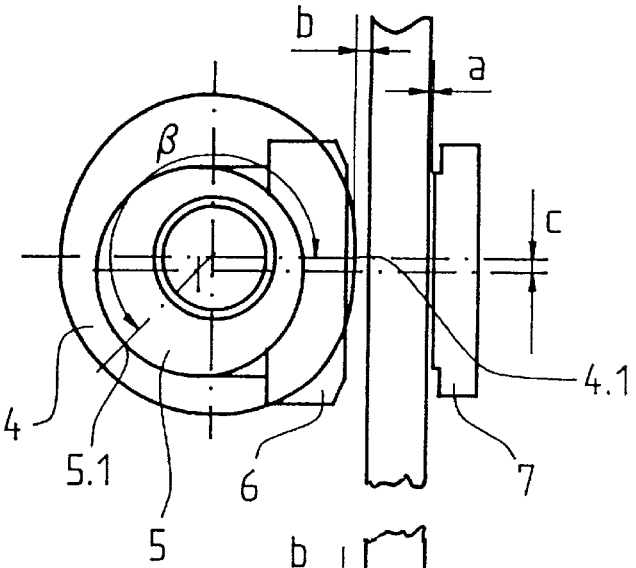
FIGS. 5 to 7 show a sequence of functioning as the progressive safety gear engages when travelling in the upward direction.

FIG. 5 is comparable to FIG. 2 and shows the same ready position of the progressive safety gear. It will now be assumed that the elevator car is travelling upwards and braking by the safety gear is about to occur. When this braking in the upward direction takes place, the braking force is determined by, among other things, the angle beta between the points 4.1 and 5.1, or the working angle that depends on this angle (e.g. beta −30°).

Figure 6:
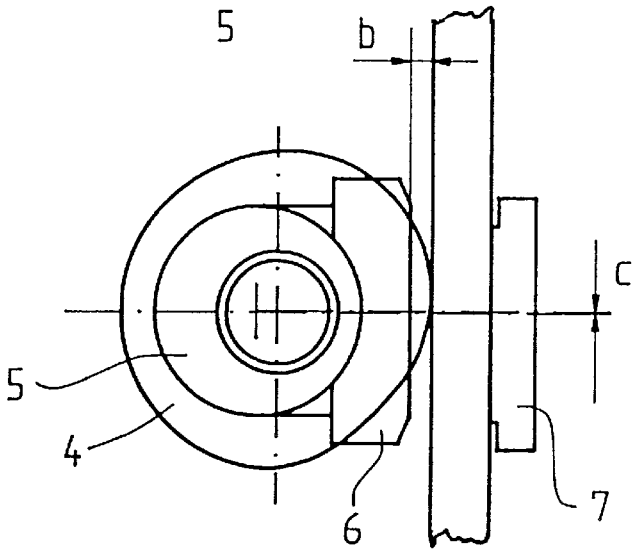

If tripping has taken place, an initial rotation applied by the triggering device to the cam 4 brings it into contact with the guide rail 8 as shown in FIG. 6 and the upward travel of the car causes the cam 4 to be rotated further. The movement of the entire safety gear to the left by a few millimeters again causes the passive brake shoe 7 to be applied first and the active brake shoe 6 in this position to be momentarily moved further away from the guide rail 8 as a result of the angular position of the eccentric 5 in relation to the momentary point of contact between the cam 4 and the guide rail 8.

Figure 7:
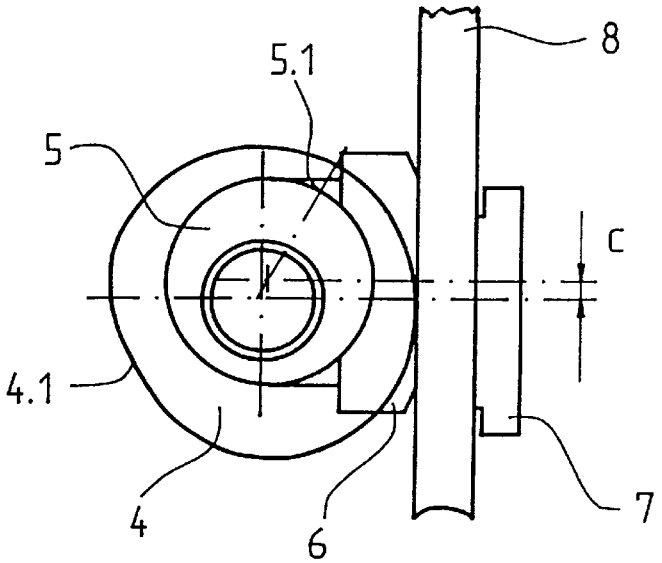

FIG. 7 shows the braking position. In the upward direction the angular displacement moved through by the cam 4 before equilibrium of forces occurs in relation to the active brake shoe 6 is greater than in the downward direction. The sum of the horizontal lengths of the radii of the eccentric 5 and the cam 4 in this position is less than in the downward direction, which also causes a smaller amount of compression of the pressure springs 9 and results in the lower level of braking force in the upward direction. In the illustrated embodiment the actuating element 21, or more specifically the upper dead point 5.1 of the eccentric 5, comes to rest at an angle of approximately 60° before the point of contact with the guide rail 8.

Figure 8:
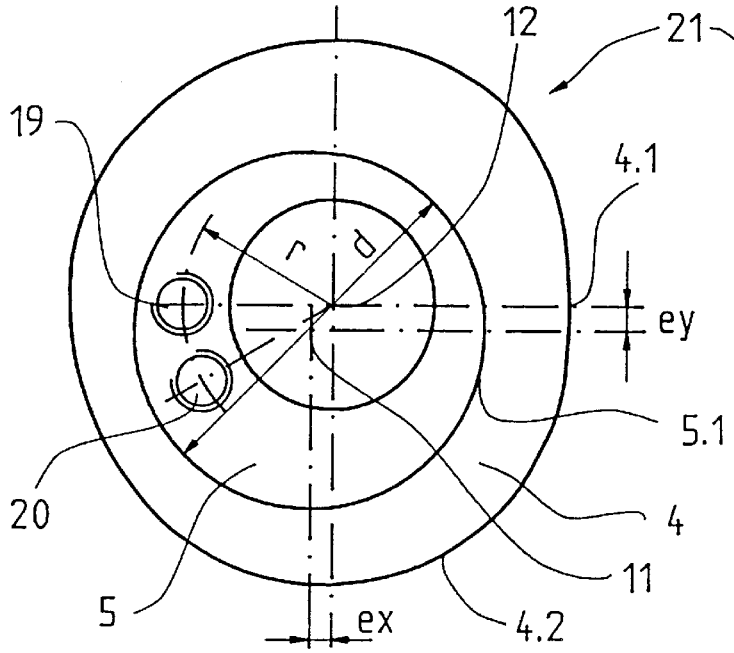
FIG. 8 is a plan view of the single-part actuating element.
Figure 9:
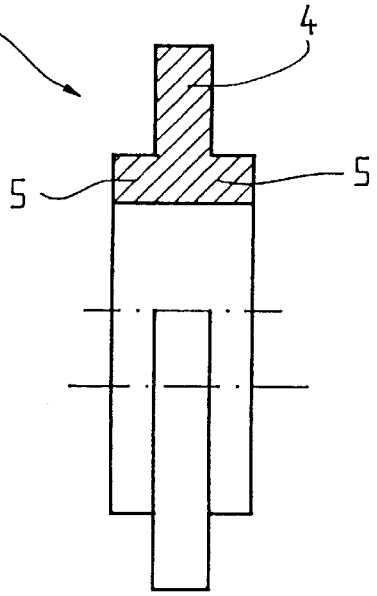
FIG. 9 is a cross-section of the single-part actuating element of FIG. 8, along the line IX—IX.

With reference to FIGS. 8 and 9 there follows below a description of two different versions of the actuating element 21.

FIG. 8 shows in a plan view further details of the actuating element 21. The geometric center 11 of the eccentric 5 is offset from the center 12 of the bearing journal 2 by the distance e-x in the horizontal direction and e-y in the vertical direction. On the left-hand side two tapped holes 19, 20 are positioned on the arc of a circle at radius r from the center 12 of the bearing journal 12. These holes 19, 20 are for the purpose of attaching a triggering device which is not shown. In this embodiment the rolling contour 4.2 of the cam 4 is a calculated, asymmetrical radial cam with a flat point whose midpoint is at 4.1. For certain applications a circular cam 4.2 with or without a flat point can also be used. It can also be seen that the eccentric 5 with the center 11 has a circular external contour with diameter d.

FIG. 9 shows a cross-sectional view of the operating element 21 in its single-part version.

Figure 10:
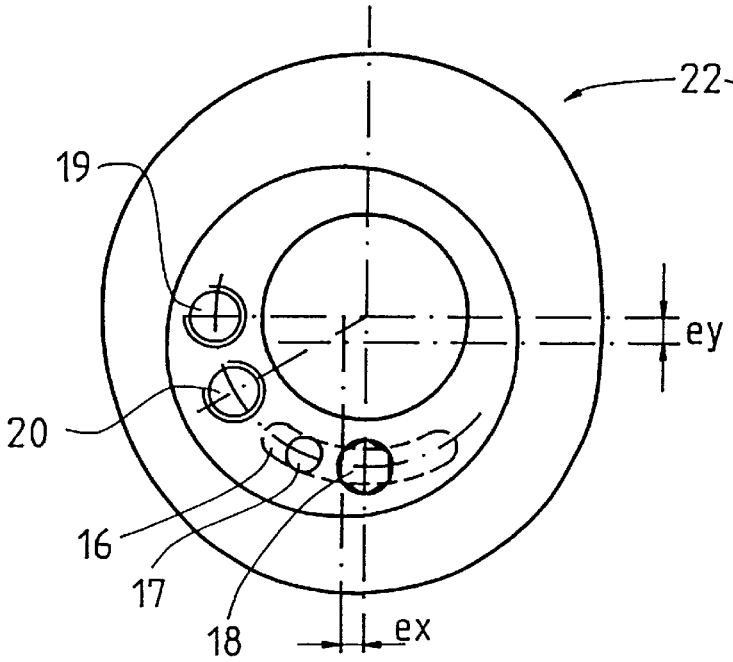
FIG. 10 is a plan view of the multi-part and adjustable actuating element.
Figure 11:
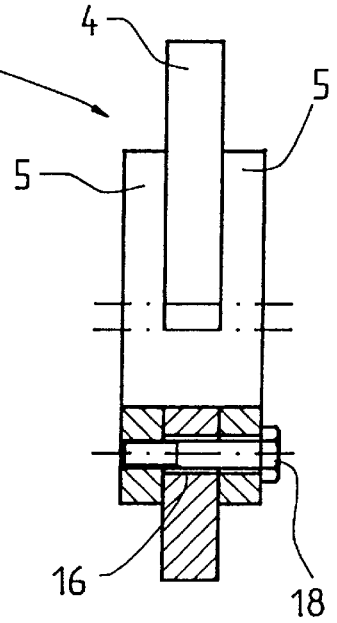
FIG. 11 is a cross-section of the multi-part and adjustable actuating element of FIG. 10, along the line XI—XI.

A further variation is illustrated in FIGS. 10 and 11 which show the multi-part and adjustable version of the operating element 22. In FIG. 10 a broken line shows in the cam 4 a slot 16 in the shape of an arc of a circle which can extend over an angle of between 30° and 60°. The two parts of the eccentric 5 are fastened together by means of a coupling bolt 17 so that they are always in the same position relative to each other and can only be angularly displaced in synchrony with each other relative to the cam 4. By rotating the position of the eccentric 5 relative to the cam 4 any desired angular position can be set within the range of the arc-shaped slot 16. An angular position to which the eccentric has been adjusted relative to the cam 4 can be fixed by means of a tension screw 18.

FIG. 11 shows in cross-section the tension screw 18 and the arc-shaped slot 16.

As already mentioned, the ability to adjust the angle between the cam 4 and the eccentric 5 makes it possible to influence certain parameters of force, and to some extent the ratio of the braking forces in the upward and downward directions, and the onset of the braking effect. One of several circumstances under which this can be of significance is if the balancing of an elevator installation deviates from the normal value for operational reasons.

When the progressive safety gear is activated the bearing journal 2 and the borehole in the actuating element 21 have to absorb large forces during the rotating movement of the actuating element 21 and at standstill after braking has taken place. The bearing must not be damaged by pitting under these circumstances, because this would endanger proper functioning and it would no longer be possible to release the safety gear. The plain bearing bush 23 inserted between the bearing journal 2 and the borehole in the actuating element 21 therefore serves the purpose of keeping the level of bearing friction as low as possible when high levels of specific pressure occur in the bearing. It is preferable for the plain bearing bush 23 to be made from a special maintenance-free sintered material which is still able to slide well even under high specific pressure. The plain bearing bush 23 is used instead of a needle bearing and takes up less space.

The plain bearing bush 23 can be omitted if materials are suitably paired (e.g. different types and hardnesses of steel), if special lubricants are used, and for smaller loads.

For the material of the operating element 21, 22 it is preferable to use a type of steel suitable for hardening.

The entire progressive safety gear is supported by the supporting structure of the car in a manner well known to those in the art and in such a way that the lateral movement, which is necessary to center the safety gear relative to the guide rail 8 when the safety gear engages, is possible. It is not necessary for the progressive safety gear according to the invention to be mounted in a way that allows lateral movement in those cases where the guiding devices are connected to the car construction in such a way as to damp vibrations and can therefore absorb a lateral displacement of a few millimeters.

The invention is not limited by the embodiments described above which are presented as examples only but can be modified in various ways within the scope of protection defined by the appended patent claims.

I claim:

1. A progressive safety gear for an elevator having guide rail for an elevator car, the safety gear comprising:

a console arrangeable so as to encompass the guide rail and be in a transverse direction to the guide rail;

an active brake shoe and a passive brake shoe supported on the console so as to be positioned one on each side of the guide rail;

a cam rotatably mounted on the console; and an eccentric fastened to the cam so that they rotate together between a ready position and braking positions defined by rotation of the eccentric and cam, the cam and the eccentric being rotatable about a common center, the cam being rotatable in both a clockwise and a counter-clockwise direction so that the safety gear and brake shoes can be tripped in both travel directions, and the cam being configured so as to remain in contact with the guide rail in the braking position after a braking operation has taken place so as to permit the cam to be turned backwards, thereby making it possible to release the engaged safety gear and the brake shoes by pulling the elevator car out of a position in which it is blocked.

2. A progressive safety gear according to claim 1, and further comprising means for mounting the passive brake shoe to the console so that the passive brake shoe has an amount of vertical play between a stop and an end face of the passive brake shoe, whereby when the safety gear is released the passive brake shoe is initially moved without friction in the direction of release.

3. A progressive safety gear according to claim 1, wherein the eccentric is configured to have a contour with an upper dead point and the cam is configured to have a contour with a zero point nearest to the guide rail in the ready position, the upper dead point and the zero point being at an angle from one another, a ratio of braking forces to each other in upward and downward directions being determined by one of the angle between the upper dead point of the eccentric and the zero point of the cam and a rolling angle which is dependent on the angle between the upper dead point and the zero point up to a point of braking.

4. A progressive safety gear according to claim 1, wherein the cam has a rolling contour with a flat point which is turned towards the guide rail in the ready position of the cam so as to control a rapid onset of braking action.

5. A progressive safety gear according to claim 1, wherein the cam has a circular rolling contour.

6. A progressive safety gear according to claim 1, wherein the cam and the eccentric are formed as a single-part actuating element.

7. A progressive safety gear according to claim 1, wherein the cam and the eccentric are connected together to form an actuating element having a multi-part construction.

8. A progressive safety gear according to claim 7, and further comprising means for changing angular position between the eccentric and the cam by turning the eccentric relative to the cam.

* * * * *